US008083470B2

(12) United States Patent
Yu et al.

(10) Patent No.: US 8,083,470 B2
(45) Date of Patent: Dec. 27, 2011

(54) FAN AND IMPELLER THEREOF

(75) Inventors: Po-Hao Yu, Taoyuan Hsien (TW); Chen-Min Wang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 665 days.

(21) Appl. No.: 12/209,496

(22) Filed: Sep. 12, 2008

(65) Prior Publication Data

US 2009/0196744 A1 Aug. 6, 2009

(30) Foreign Application Priority Data

Feb. 1, 2008 (TW) ..... 97103930 A

(51) Int. Cl.
*F03D 11/00* (2006.01)

(52) U.S. Cl. ..... 415/119; 415/175; 416/228; 416/243

(58) Field of Classification Search ..... 415/119, 415/175, 220, 222, 207; 416/228, 243
See application file for complete search history.

(56) References Cited

U.S. PATENT DOCUMENTS

| | | | | |
|---|---|---|---|---|
| 4,225,285 | A * | 9/1980 | Sturm | 415/207 |
| 6,499,948 | B1 * | 12/2002 | Iyer et al. | 415/220 |
| 7,125,220 | B2 * | 10/2006 | Horng et al. | 415/119 |
| 7,614,250 | B2 | 11/2009 | Sanagi | |
| 7,752,858 | B2 * | 7/2010 | Johnson et al. | 62/186 |
| 2003/0156945 | A1 * | 8/2003 | Suzuki | 416/228 |
| 2005/0249585 | A1 * | 11/2005 | Horng et al. | 415/119 |
| 2008/0101964 | A1 * | 5/2008 | Iwase et al. | 417/321 |

FOREIGN PATENT DOCUMENTS

| | | |
|---|---|---|
| CN | 1508440 | 6/2004 |
| CN | 101090210 | 12/2007 |
| CN | 101105180 | 1/2008 |
| TW | 545525 | 8/2003 |

* cited by examiner

*Primary Examiner* — David Nhu

(74) *Attorney, Agent, or Firm* — Muncy, Geissler, Olds & Lowe, PLLC

(57) ABSTRACT

A fan includes a frame, a motor and an impeller. The motor is disposed on the frame and coupled to the impeller to drive the impeller to rotate. The impeller includes a hub, a plurality of blades and an air exhausting structure. The hub has an opening formed on a top portion of the hub. The blades are disposed around the hub. The air exhausting structure is disposed in the opening for discharging hot airs generated by the motor out of the hub.

19 Claims, 3 Drawing Sheets

FAN AND IMPELLER THEREOF

CROSS REFERENCE TO RELATED APPLICATIONS

This Non-provisional application claims priority under 35 U.S.C. §119(a) on Patent Application No(s). 097103930, filed in Taiwan, Republic of China on Feb. 1, 2008, the entire contents of which are hereby incorporated by reference.

BACKGROUND OF THE INVENTION

1. Field of Invention

The present invention relates to a fan and an impeller thereof with a self heat-dissipating function.

2. Related Art

Since electronic products are developed towards high performance, high frequency and minimization, heats generated by the electronic products are accordingly increased. The generated heats may affect the reliability and lifetime of the electronic products, so that the heat dissipation thereof has become an important issue. It is a common solution to use a fan to dissipate the heat. However, when the fan operates, the coils thereof will be heated to high temperature, which may be harmful to the bearing or affect the motor efficiency.

As shown in FIG. 1, a conventional fan 1 includes a motor 10 and an impeller 11 driven by the motor 10. The impeller 11 is instituted by blades 111 and a hub 112 for accommodating the motor 10. The hub 112 has several holes 113 formed on the top portion thereof for indusing airflows from outside of the hub 112 to the interior of the fan 1 through the holes 113. The dotted arrow lines shown in FIG. 1 indicate the direction of the airflows.

Such conventional fan 1 mainly utilizes the airflows to carry the external cold air via passing through the hub 112 with the holes 113 for dissipating the internal heat. However, the flow of the cold air may be counteracted by the raised the hot air, thereby decreasing the heat dissipation efficiency. In addition, the airflows also carry dusts, foreign matters and moistures into the fan 1, so that the motor and internal components may be easily damaged.

SUMMARY OF THE INVENTION

In view of the foregoing, the present invention is to provide a fan and an impeller thereof having an air exhausting structure disposed in the hub to discharge internal hot airs out, so that the heats generated by the operating motor can be dissipated by the impeller so as to avoid the malfunctions of components caused by the heat accumulation and prevent the foreign matters from entering the internal of the fan.

To achieve the above, the present invention discloses a fan including a frame, a motor and an impeller. The motor is disposed on the frame and coupled to the impeller to drive it to rotate. The impeller includes a hub, a plurality of blades and an air exhausting structure. The hub has an opening formed on a top portion of the hub. The blades are disposed around the hub. The air exhausting structure is disposed in the opening for discharging hot airs generated by the motor out of the hub.

Preferably, the air exhausting structure includes a central portion and a plurality of connecting members. The central portion is connected with a side wall of the hub via the connecting members. The connecting members, such as a plurality of vanes or ribs, are annularly disposed between the central portion and the hub. The tilted or curved direction of the connecting members and that of the blades reverse from each other. The central portion is an upside-down cone-shaped structure.

In addition, the fan further includes a magnetic conducting case disposed in the hub. The magnetic conducting case is a hollow case. The fan is an axial-flow fan or a centrifugal fan.

As mentioned above, the fan and impeller of the present invention can discharge heats generated by the motor out via the air exhausting structure, which is disposed in the hub of the impeller. Thus, the heat accumulation problem can be solved. Compared with prior art, the present invention can avoid heat accumulation inside the fan and prevent the foreign matters from entering into the fan because the airflow direction of hot airs is from the internal to the external of the fan. Thus, the reliability and lifetime of the fan can be improved.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
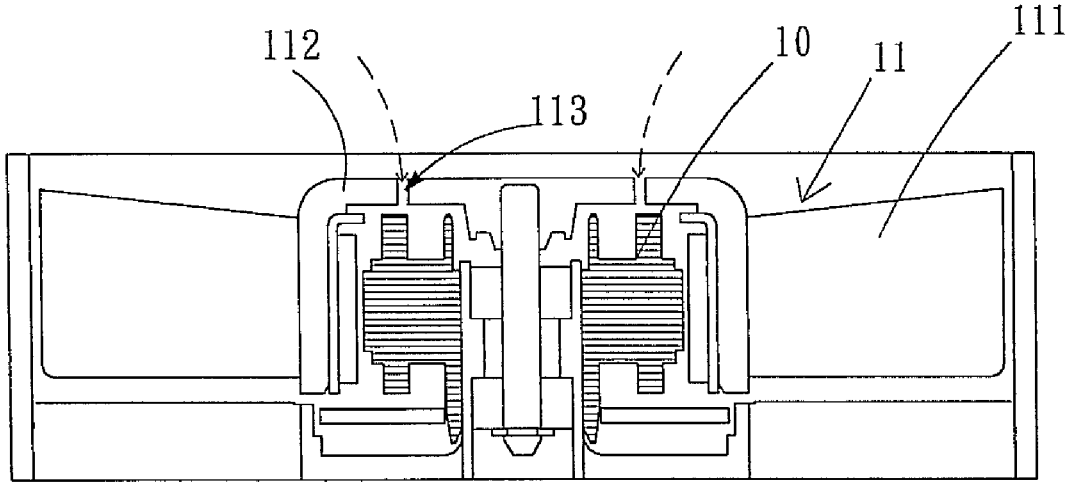
FIG. 1(PRIOR ART)
FIG. 1 is a cross-sectional view of a conventional fan.
Figure 2:
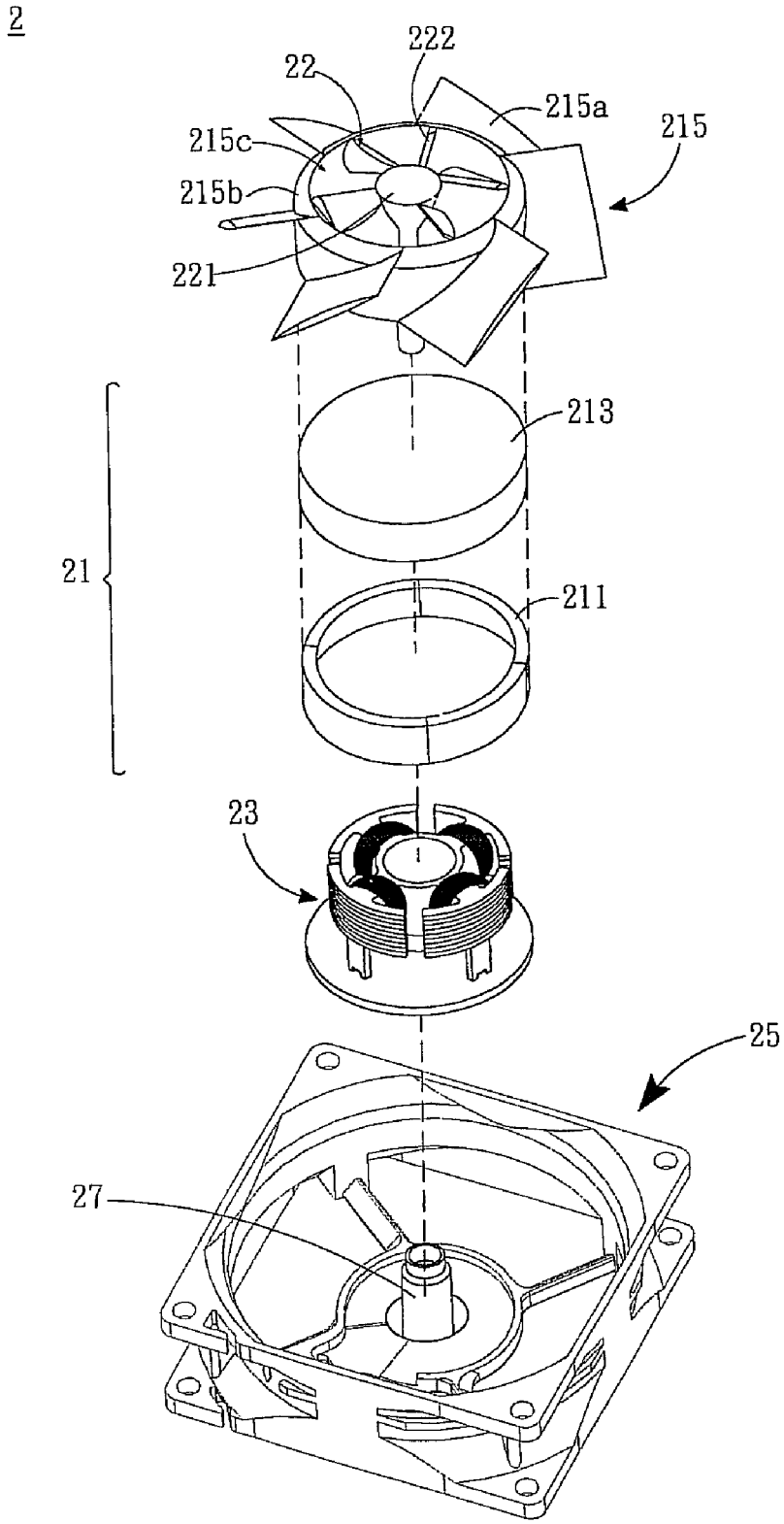
FIG. 2 is an exploded diagram showing a fan according to an embodiment of the present invention.
Figure 3:
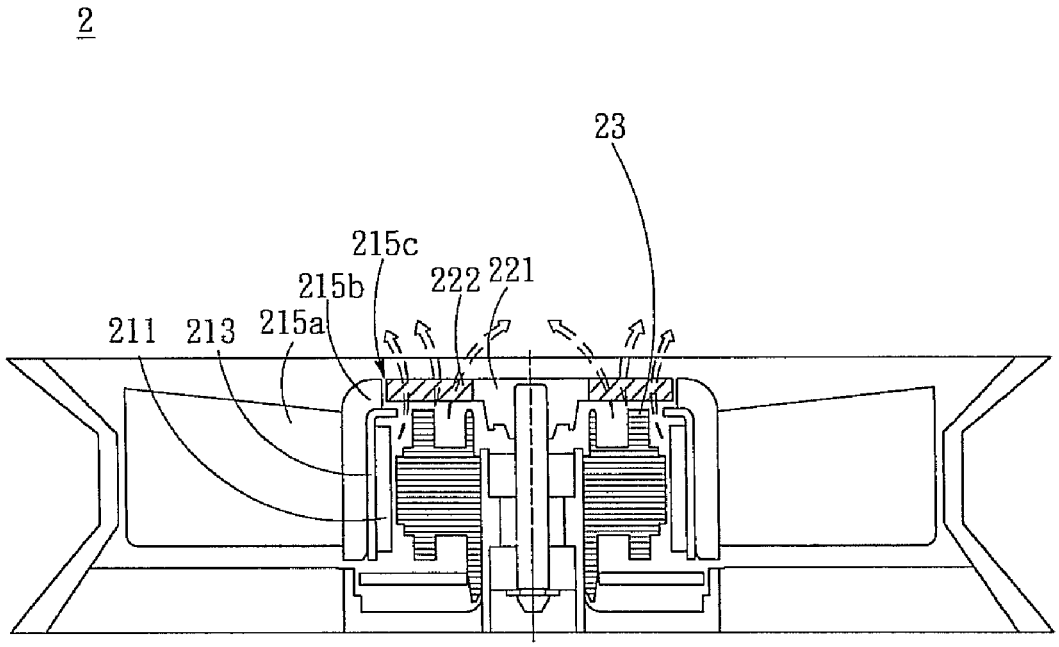
FIG. 3 is a cross-sectional view of the assembled fan of FIG. 2.

With reference to FIGS. 2 and 3, a fan 2 according to an embodiment of the present invention includes a motor, an impeller 215, a frame 25 and a bushing 27. The motor and impeller 215 are disposed in the frame 25.

The motor includes a rotor 21 and a stator 23. The rotor 21 includes a magnetic ring 211 and a magnetic conducting case 213. The magnetic ring 211 is disposed in the magnetic conducting case 213. The magnetic conducting case 213 is a hollow case and the magnetic conducting case 213 is disposed in the hub 215*b* of the impeller 215.

In the embodiment, the fan 2 can be an axial-flow fan or a centrifugal fan. Since the motor is disposed in the impeller 215 and coupled to the impeller 215, the operation of the motor can drive the impeller 215 to rotate.

Referring to FIG. 2, the impeller 215 includes a plurality of blades 215*a*, a hub 215*b* and an air exhausting structure 22. The blades 215*a* are disposed around the hub 215*b*. The hub 215*b* has an opening 215*c*, and the air exhausting structure 22 is disposed in the opening 215*c* of the hub 215*b*.

In more detail, the air exhausting structure 22 includes a central portion 221 and a plurality of connecting members 222. The central portion 221 is connected with the inner side wall of the opening 215*c* of the hub 215*b* via the connecting members 222. As shown in FIG. 2, the central portion 221 is an upside-down cone-shaped structure and is coupled to the shaft of the rotor 21. The connecting members 222 are, for example but not limited to, annularly disposed around the central portion 221 and between the central portion 221 and the hub 215*b*.

As shown in FIG. 2, the tilted or curved direction of the connecting members 222 of the air exhausting structure 22 and that of the blades 215 a reverse from each other. When the motor drives the impeller 215 to rotate, the air exhausting structure 22 as well as the connecting members 222, which are connected to the impeller 215, are driven to rotate simultaneously. Therefore, the heats generated by the motor can be discharged through the hollow magnetic conducting case 213 and the air exhausting structure without accumulating inside the magnetic conducting case 213. The dotted arrow lines shown in FIG. 3 indicate the dissipation direction of hot air.

To achieve optimum heat dissipation effect, the connecting members 222 can include a plurality of vanes or a plurality of ribs.

In addition, since the impeller 215 is connected to the air exhausting structure 22, the rotation speed of the air exhausting structure 22 increases as the rotation speed of the impeller 215 increases. Thus, the hot airs inside the operating motor can be discharged faster. Accordingly, the advantage of the present invention is much obvious when it is applied to the high-speed fans.

In summary, the fan and impeller of the present invention can discharge the heat generated by the motor out via the air exhausting structure, which is disposed in the hub of the impeller. Thus, the heat accumulation problem can be solved. Compared with prior art, the present invention can avoid the heat accumulation inside the fan and prevent the foreign matters from entering into the fan because the airflow direction of hot airs is from the internal to the external of the fan. Thus, the reliability and lifetime of the fan can be improved. In addition, the air exhausting structure can be rotated along with the hub. Thus, when the present invention is applied to a high-speed fan, the rotation speed of the air exhausting structure can be increased as that of the impeller increases, so that the discharge of the hot air can be speeded up without heat accumulation.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An impeller driven by a motor, the impeller comprising:
a hub having an opening formed on a top portion of the hub;
a plurality of blades disposed around the hub; and
an air exhausting structure disposed in the opening of the hub for discharging hot airs generated by the motor out of the hub.

2. The impeller according to claim 1, wherein the air exhausting structure comprises a central portion and a plurality of connecting members.

3. The impeller according to claim 2, wherein the central portion is connected with a side wall of the hub via the connecting members.

4. The impeller according to claim 2, wherein the connecting members are annularly disposed between the central portion and the hub.

5. The impeller according to claim 2, wherein the connecting members are a plurality of vanes or a plurality of ribs.

6. The impeller according to claim 2, wherein a tilted or curved direction of the connecting members and that of the blades reverse from each other.

7. The impeller according to claim 2, wherein the central portion is an upside-down cone-shaped structure.

8. A fan, comprising:
a frame;
a motor disposed on the frame; and
an impeller coupled to the motor and driven by the motor, wherein the impeller comprises a hub, a plurality of blades and an air exhausting structure, the hub has an opening formed on a top portion of the hub, the blades are disposed around the hub, and the air exhausting structure is disposed in the opening of the hub for discharging hot airs generated by the motor out of the hub.

9. The fan according to claim 8, wherein the air exhausting structure comprises a central portion and a plurality of connecting members.

10. The fan according to claim 9, wherein the central portion is connected with a side wall of the hub via the connecting members.

11. The fan according to claim 9, wherein the connecting members are annularly disposed between the central portion and the hub.

12. The fan according to claim 9, wherein the connecting members are a plurality of vanes or a plurality of ribs.

13. The fan according to claim 9, wherein a tilted or curved direction of the connecting members and that of the blades reverse from each other.

14. The fan according to claim 9, wherein the central portion is an upside-down cone-shaped structure.

15. The fan according to claim 8, further comprising a magnetic conducting case disposed in the hub.

16. The fan according to claim 15, wherein the magnetic conducting case is a hollow case.

17. The fan according to claim 8, wherein the fan is an axial-flow fan or a centrifugal fan.

18. An impeller driven by a motor, the impeller comprising:
a hub having an opening formed on a top portion of the hub;
a plurality of blades disposed around the hub;
an air exhausting structure disposed in the opening for discharging hot airs generated by the motor out of the hub; and
a plurality of connecting members, a tilted or curved direction of the connecting members and that of the blades are reverse from each other.

19. A fan, comprising:
a frame;
a motor disposed on the frame;
an impeller coupled to the motor and driven by the motor, wherein the impeller comprises a hub, a plurality of blades and an air exhausting structure, the hub has an opening formed on a top portion of the hub, the blades are disposed around the hub, and the air exhausting structure is disposed in the opening for discharging hot airs generated by the motor out of the hub; and
a magnetic conducting case disposed in the hub.

* * * * *